US007449664B2

(12) United States Patent
Spencer

(10) Patent No.: US 7,449,664 B2
(45) Date of Patent: Nov. 11, 2008

(54) OIL AND GAS WELL ALLOY SQUEEZING METHOD AND APPARATUS

(76) Inventor: Homer L. Spencer, 220 Pump Hill Rise S.W., Calgary, Alberta (CA) T2V 4C8

( * ) Notice: Subject to any disclaimer, the term of this patent is extended or adjusted under 35 U.S.C. 154(b) by 0 days.

(21) Appl. No.: 10/953,079

(22) Filed: Sep. 28, 2004

(65) Prior Publication Data

US 2005/0109511 A1 May 26, 2005

Related U.S. Application Data

(60) Division of application No. 10/251,339, filed on Sep. 19, 2002, now Pat. No. 6,828,531, which is a continuation-in-part of application No. 10/177,726, filed on Jun. 20, 2002, now Pat. No. 6,664,522, which is a continuation-in-part of application No. 10/084,986, filed on Feb. 27, 2002, which is a continuation-in-part of application No. 09/539,184, filed on Mar. 30, 2000, now Pat. No. 6,384,389.

(51) Int. Cl.
*H05B 6/10* (2006.01)

(52) U.S. Cl. ..... 219/635; 219/607; 166/304; 166/60

(58) Field of Classification Search ..... 219/635, 219/607, 161, 603, 611, 614, 615–617, 629, 219/227, 233; 166/60, 304, 248, 65.5, 284, 166/285, 300, 302; 205/731; 156/221; 141/2; 428/546, 559; 299/14; 405/131
See application file for complete search history.

(56) References Cited

U.S. PATENT DOCUMENTS

| | | | | | |
|---|---|---|---|---|---|
| 2,302,774 | A | * | 11/1942 | Jarvis | 219/629 |
| 2,556,609 | A | * | 6/1951 | Smurthwaite | 219/227 |
| 2,647,196 | A | * | 7/1953 | Carpenter et al. | 166/60 |
| 3,029,195 | A | * | 4/1962 | Marsh et al. | 205/731 |
| 3,443,059 | A | * | 5/1969 | Spencer | 219/233 |
| 4,303,108 | A | * | 12/1981 | Akers et al. | 141/2 |
| 4,510,005 | A | * | 4/1985 | Nijman | 156/221 |

* cited by examiner

*Primary Examiner*—Quang T Van
(74) *Attorney, Agent, or Firm*—John Russell Uren

(57) ABSTRACT

Method and apparatus for melting a material and squeezing the melted material through casing perforations into a fault within the cement or formation of an oil or gas well. A heating tool carries solid material which is melted at depth within the well and adjacent to the casing perforations. The liquefied material is forced through the perforations and into the formation or the well cement. When the material cools and solidifies, the faults become sealed.

5 Claims, 19 Drawing Sheets

OIL AND GAS WELL ALLOY SQUEEZING METHOD AND APPARATUS

CROSS-REFERENCE TO RELATED APPLICATIONS

This application in a divisional of continuation-in-part application Ser. No. 10/251,339 filed Sep. 19, 2002, now U.S. Pat. No. 6,828,531, which was a continuation-in-part of application Ser. No. 10/177,726 filed Jun. 20, 2002, now U.S. Pat. No. 6,664,522 which is a continuation-in-part of application Ser. No. 10/084,986 filed Feb. 27, 2002 which is a continuation-in-part of application Ser. No. 09/539,184 filed Mar. 30, 2000, now issued on May 7, 2002 under U.S. Pat. No. 6,384,389.

INTRODUCTION

This invention relates to a method and apparatus for repairing and/or sealing oil and gas wells and, more particularly, to a method and apparatus for sealing a cement sheath between the well casing and the wellbore in an oil or gas bearing formation.

BACKGROUND OF THE INVENTION

The leakage of shallow gas through the casing cement used in well completion is often a problem in oil and gas wells. Such leakage is generally caused by inherent high pressures in oil and gas wells and can create environmental problems and compromise well safety. This leakage most often occurs because of cracks or other imperfections that occur in the cement that is injected into the well during well completion procedures between the well casing and the wellbore.

Techniques for preventing shallow gas leakage are disclosed in Rusch, David W. et al, "Use of Pressure Activated Sealants to Cure Sources of Casing Pressure", SPE (Society of Petroleum Engineers) Paper 55996. These techniques use the application of an epoxy sealing technique. One disadvantage in using the technique taught by Rusch et al is that high pressure differentials across the source of leakage are required.

A common method in the oil industry to attempt to repair and seal leaking annular cement in an existing oil or gas well is to perform a cement "squeeze" in the problem region. This is accomplished by first perforating the casing in the region to be repaired. A plug is then set immediately below the perforated zone and cement is pumped from the surface down the casing and forced through the perforations. This cement is intended to flow into the discontinuities in the existing cement or wellbore well in order to seal them once the cement solidifies.

However, the use of cement has disadvantages. The cement used for well sealing purposes has a relatively high viscosity which limits the penetration of the cement into discontinuities both in the well formation and in the cement previously used for sealing the well. Furthermore, cement has a partially solidified state before it finally solidifies which limits the application of pressure on the cement during the squeezing operation. Such partial solidified state limits the penetration of the cement into the formation or into the cement discontinuities where the gas leakage arises.

SUMMARY OF THE INVENTION

According to one aspect of the invention, there is provided a method of squeezing a liquefied material previously in solid form through the perforated casing of an oil or gas well and into solid material surrounding said casing, said method comprising melting said material at a predetermined depth in said well with a heating tool and forcing said melted material through said perforated casing of said well and into said solid material surrounding said casing.

According to a further aspect of the invention, there is provided apparatus for heating a material used for sealing faults within the cement used for sealing an oil or gas well, said apparatus comprising a heating tool, a hollow core within said heating tool for carrying meltable material and for allowing said meltable material to liquefy upon heating by said heating tool, a piston within said heating tool for applying pressure to said meltable material following said liquefying of said meltable material within said tool and for forcing said liquefied material from said tool.

According to yet a further aspect of the invention, there is provided a method of sealing an oil or gas well with a material surrounding a well casing during completion of said oil or gas well, said method comprising melting said material on said casing at a predetermined depth of said oil or gas well and allowing said melted material to solidify within the annulus between said casing and the wellbore of said well, said solidified material thereby forming a seal within said annulus between the outside of said well casing and the inside of the wellbore of said oil or gas well.

According to yet a further aspect of the invention, there is provided a casing for an oil or gas well, said casing having a meltable material of a predetermined thickness over a predetermined length of said casing.

BRIEF DESCRIPTION OF THE SEVERAL VIEWS OF THE DRAWINGS

Specific embodiments of the invention will now be described, by way of example only, with the use of drawings in which.

DESCRIPTION OF SPECIFIC EMBODIMENT

Figure 2:
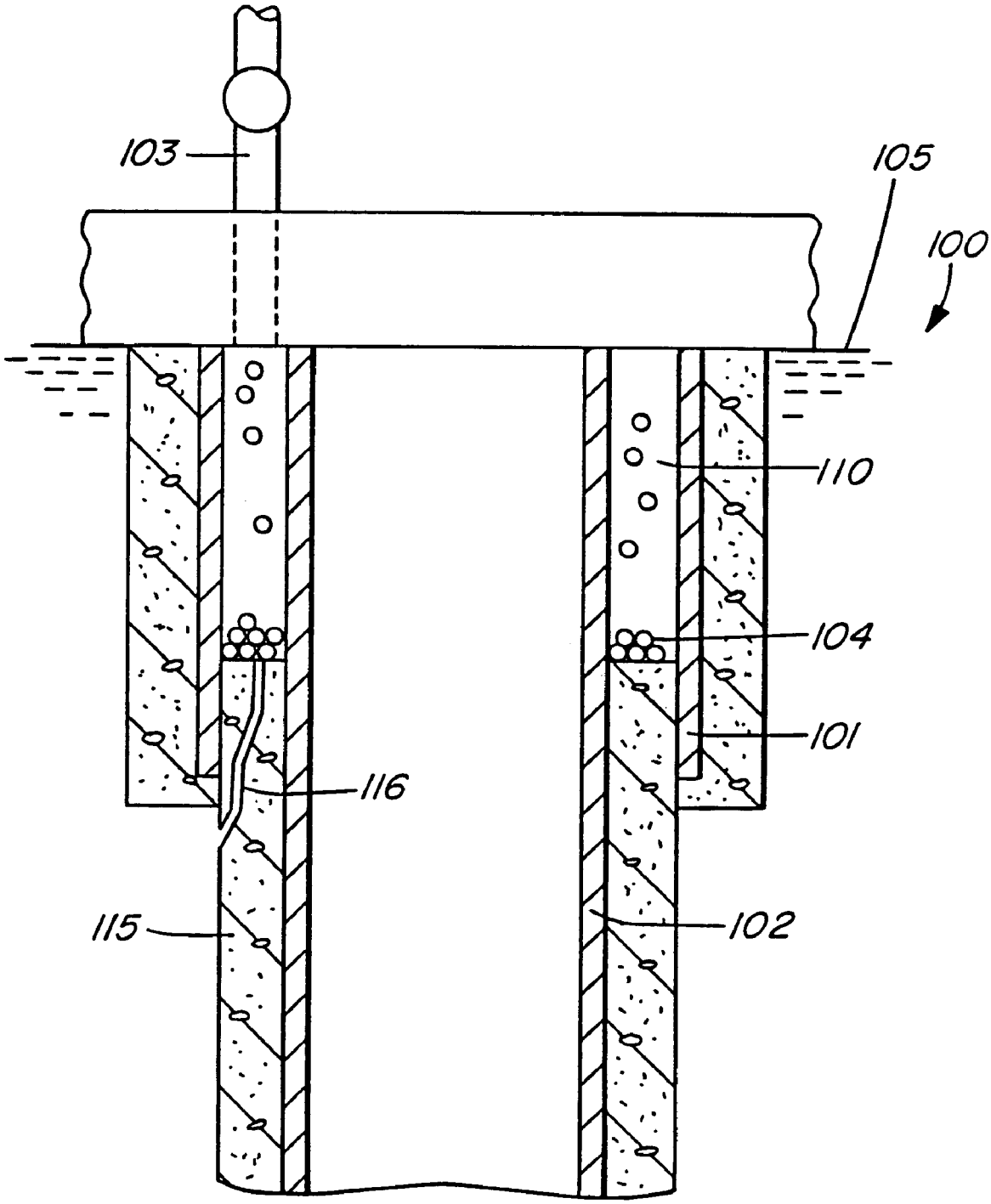
FIG. 2 is an enlarged diagrammatic cross-sectional view of an oil or gas well particularly illustrating the cement used in setting the production and surface casings relative to the metal used for sealing the annulus.
Figure 3:
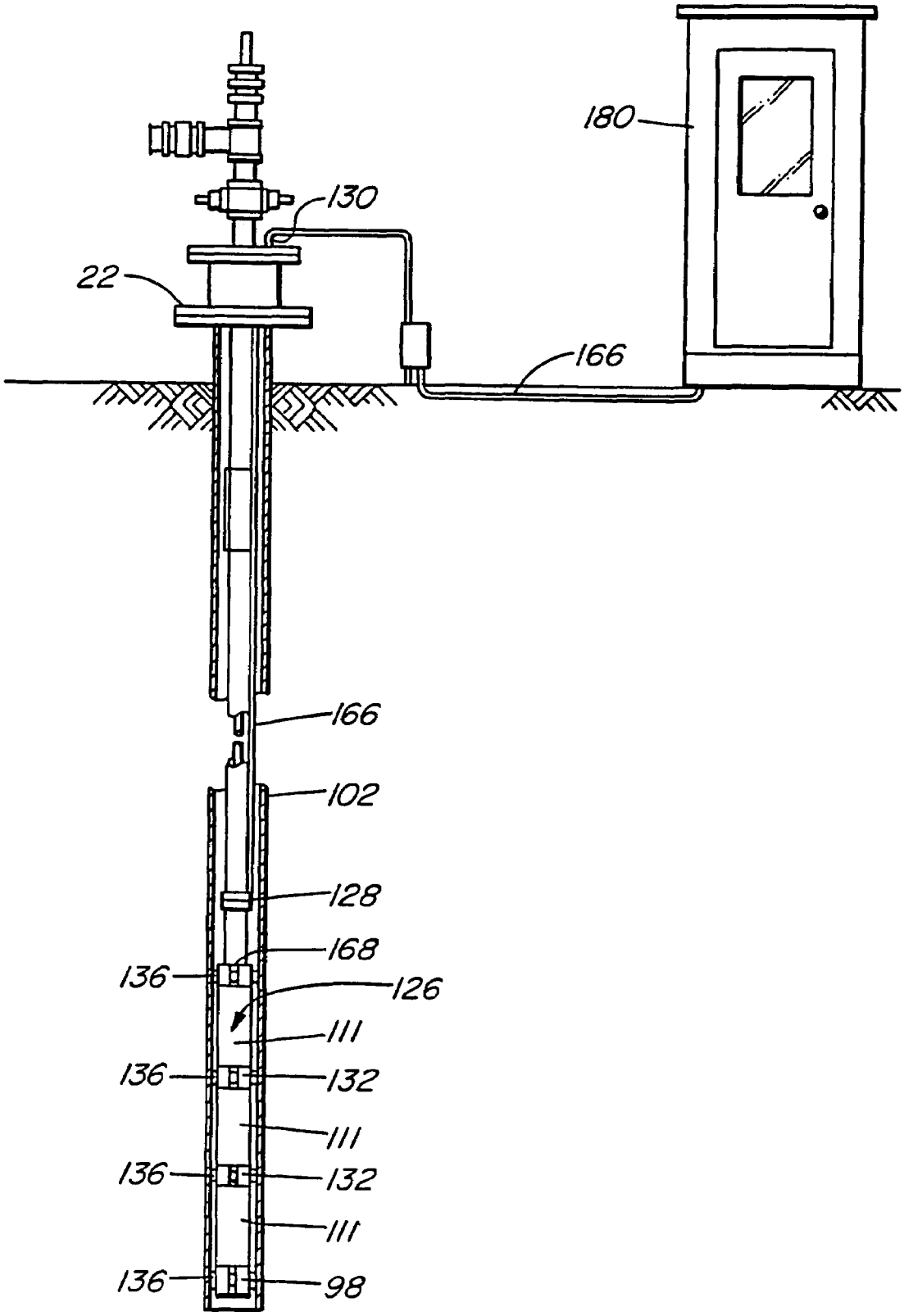
FIG. 3 is a diagrammatic side cross-sectional view of a magnetic induction assembly positioned in a vertical well and being in accordance with the present invention.

Referring now to the drawings, the surface and production casings of an oil or gas well generally illustrated at 100 are illustrated at 101, 102, respectively. The outside or surface casing 101 extends from the surface 105 (FIG. 2) of the formation downwardly and the production casing 102 extends downwardly within the surface casing 101. An annulus 110 is formed between the production and surface casings 101, 102, respectively. It will be appreciated that FIG. 2 is intended to diagrammatically illustrate an offshore well while FIG. 3 is intended to diagrammatically illustrate an onshore oil or gas well.

An injection port 103 extends downwardly from the surface into the annulus 110 between the surface and production casings 101, 102. The injection port 103 is used not only to inject certain fluids into the annulus 110 but is also used to carry small shot pellets 104 in the form of BB's which are poured into place via the injection port 103. The small shot pellets 104 are preferably made from an eutectic metal; that is, they have a relatively low melting point and can be liquified by the application of certain heat as will be explained. The injection port 103 further and conveniently may carry a suitable marker or tracer material such as radioactive boron or the like which is added to the shot 104 so that the location of the eutectic metal in the annulus 110 can be detected with standard well logging tools to ensure proper quantities of the metal being appropriate situated.

An electrical induction apparatus generally illustrated at 111 is located within the production casing 102. It may conveniently comprise three inductive elements 112, 113, 114 which are mounted on a wire line 120 which is used to raise or lower the induction apparatus 111 so as to appropriately locate it within the production casing 102 adjacent the shot pellets 104 following their placement.

The induction apparatus 111 will be described in greater detail.

More than one magnetic induction apparatus 111 (FIG. 3) may be used and they may be joined together as part of a magnetic induction assembly, generally indicated at 126. A magnetic field is induced in and adjacent to well casing 102 by means of the magnetic induction apparatus 111 thereby producing heat.

The magnetic induction assembly 126 includes an adapter sub 128, a electrical feed through assembly 130, and a plurality of magnetic induction apparatus 111 joined by conductive couplings 132.

Figure 4:
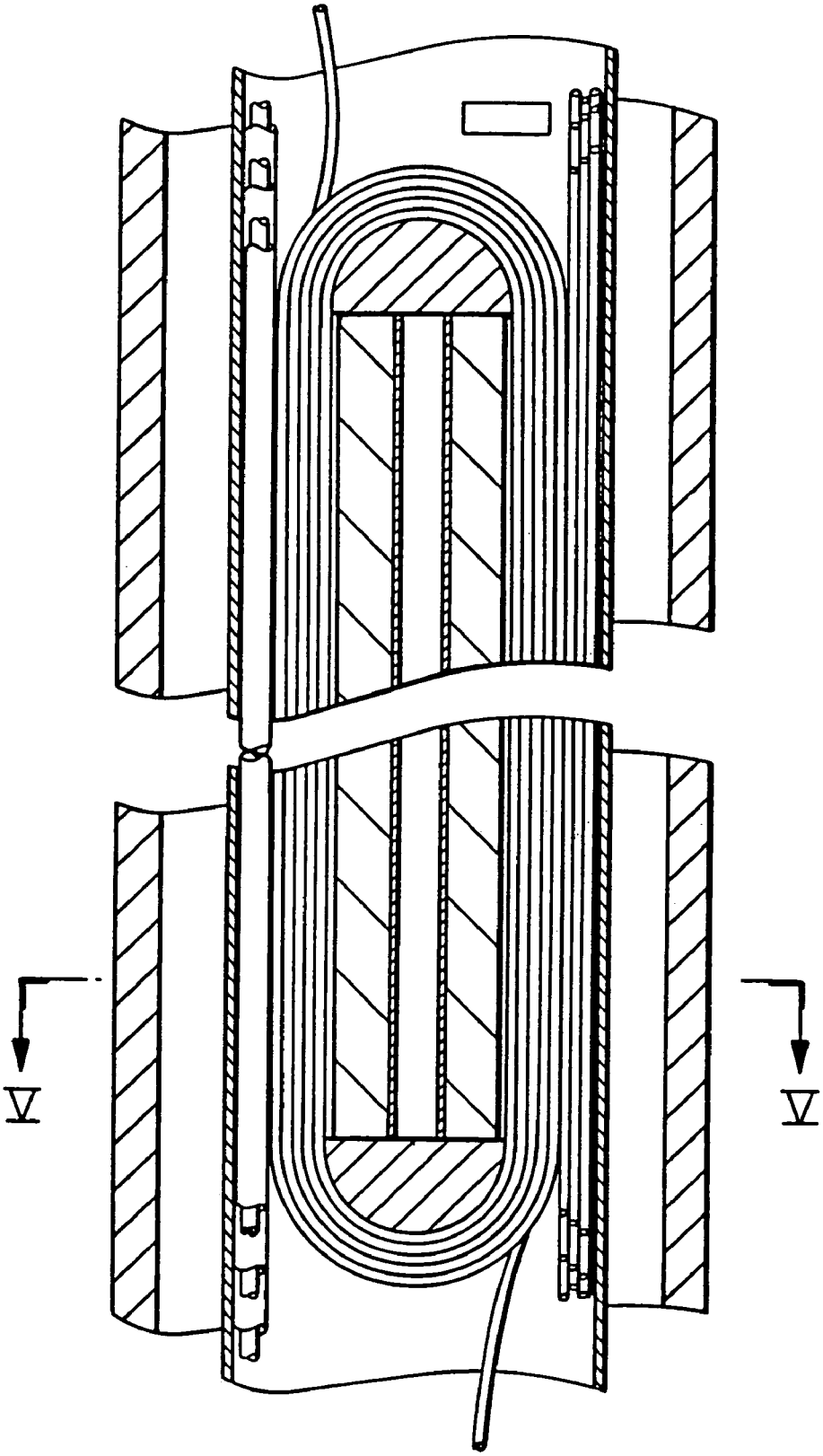
FIG. 4 is a diagrammatic side cross-sectional view of one of the magnetic induction apparatuses from the magnetic induction assembly illustrated in FIG. 3.
Figure 5:
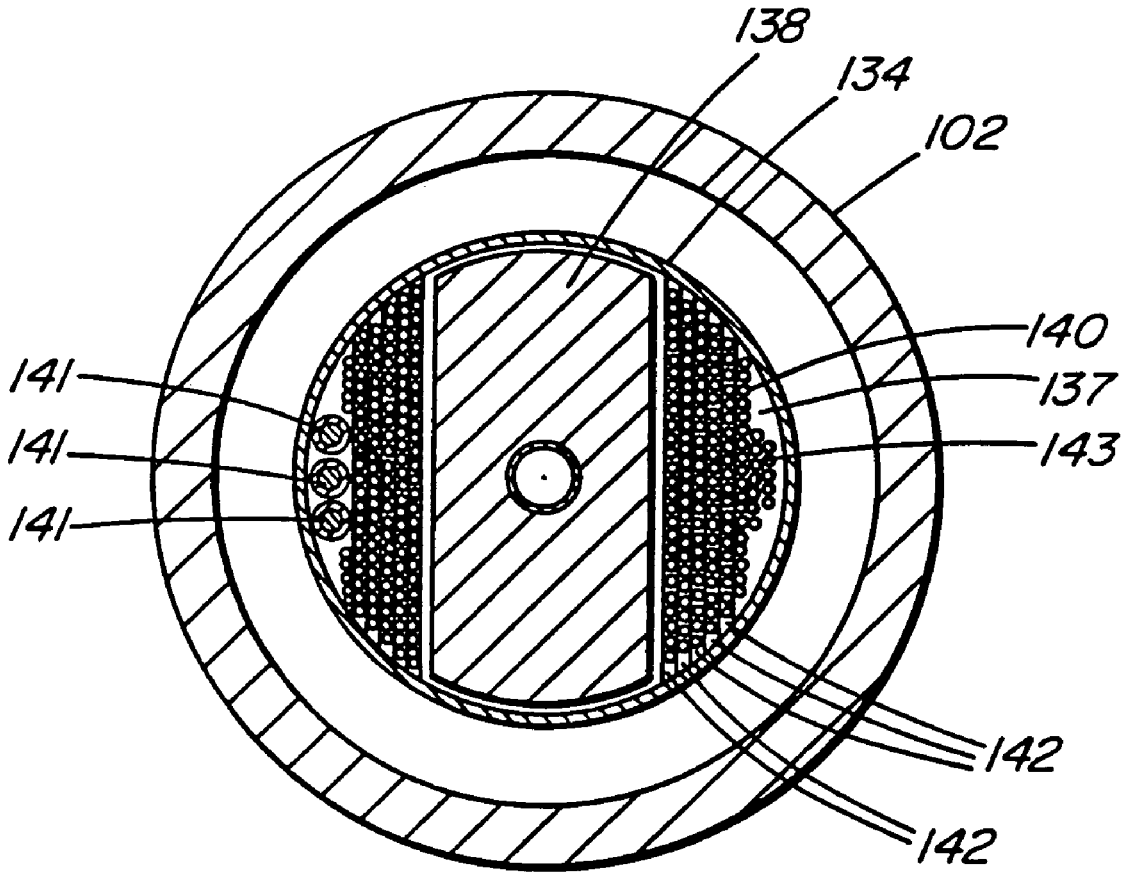
FIG. 5 is a diagrammatic plan cross-sectional view, taken along section lines V-V of the magnetic induction apparatus illustrated in FIG. 4.

Each magnetic induction apparatus 111 has a tubular housing 134 (FIGS. 4 and 5). Housing 134 may be magnetic or non-magnetic depending upon whether it is desirable to build up heat in the housing itself. Housing 134 has external centralizer members 136 (FIG. 6) and a magnetically permeable core 138 is disposed in housing 134. Electrical conductors 140 are wound in close proximity to core insulated dividers 142 which are used for electrically isolating the electrical conductors 140. Housing 134 has may be filled with an insulating liquid, which may be transformed to a substantially incompressible gel 137 so as to form a permanent electrical insulation and provide a filling that will increase the resistance of housing 134 to the high external pressures inherent in the well 100. The cross sectional area of magnetic core 138, the number of turns of conductors 140, and the current originating from the power control unit (PCU) may be selected to release the desired amount of heat when stimulated with a fluctuating magnetic field at a frequency such that no substantial net mechanical movement is created by the electromagnetic waves. Power conducting wires 141 and signal conducting wires 143 are used to facilitate connection with the PCU. For reduced heat release, a lower frequency, fewer turns of conductor, lower current, or less cross sectional area or a combination will lower the heat release per unit of length. Sections of inductor constructed in this fashion allow the same current to pass from one magnetic inductor apparatus 111 to another.

Figure 16:
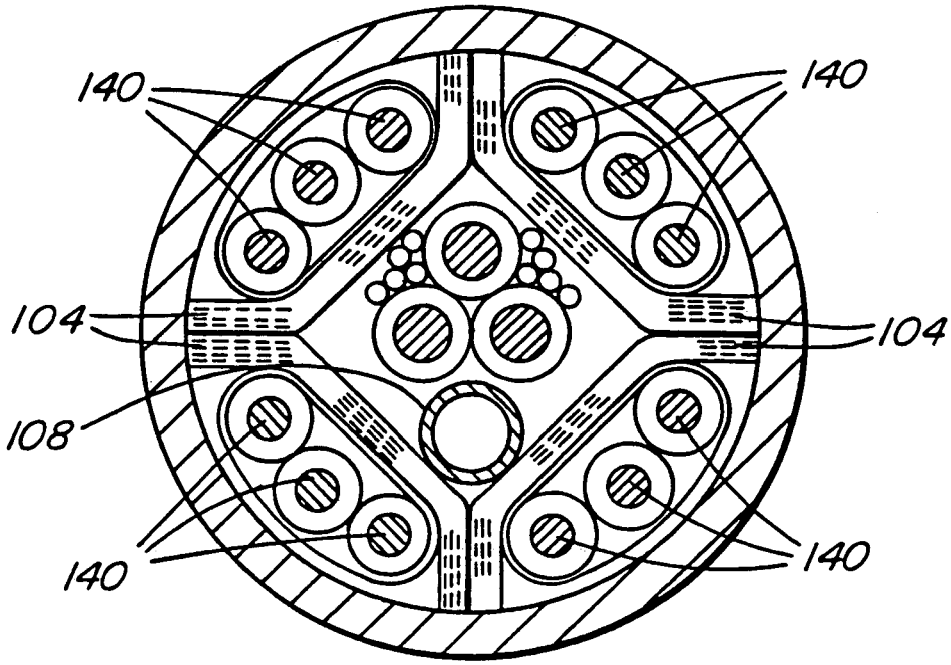
FIG. 16, appearing with FIG. 14, is an end sectional view of a first alternative internal configuration for the magnetic induction apparatus according to the invention.
Figure 17:
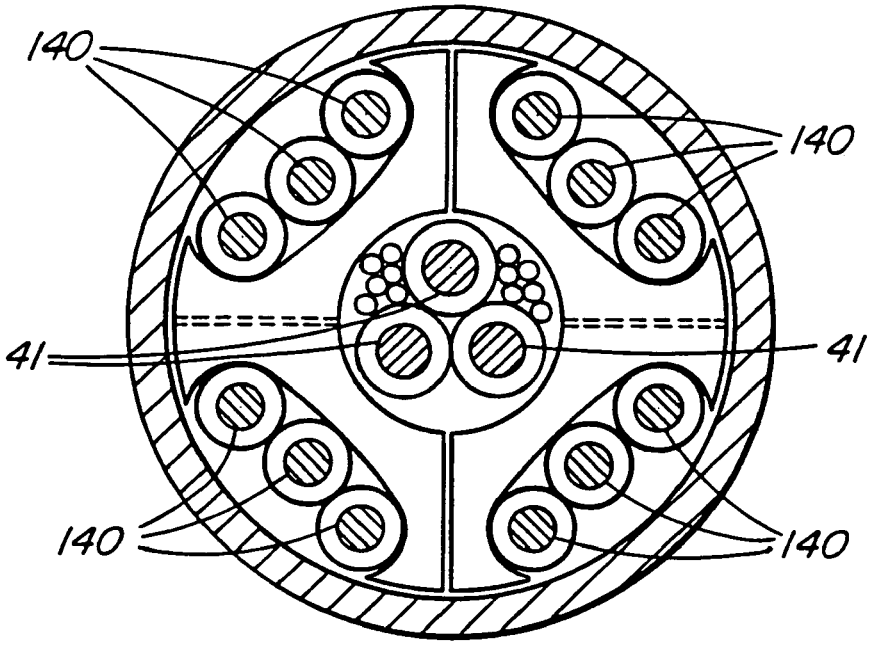
FIG. 17 is an end sectional elevation view of a second alternative internal configuration for the magnetic induction apparatus according to the invention.
Figure 18:
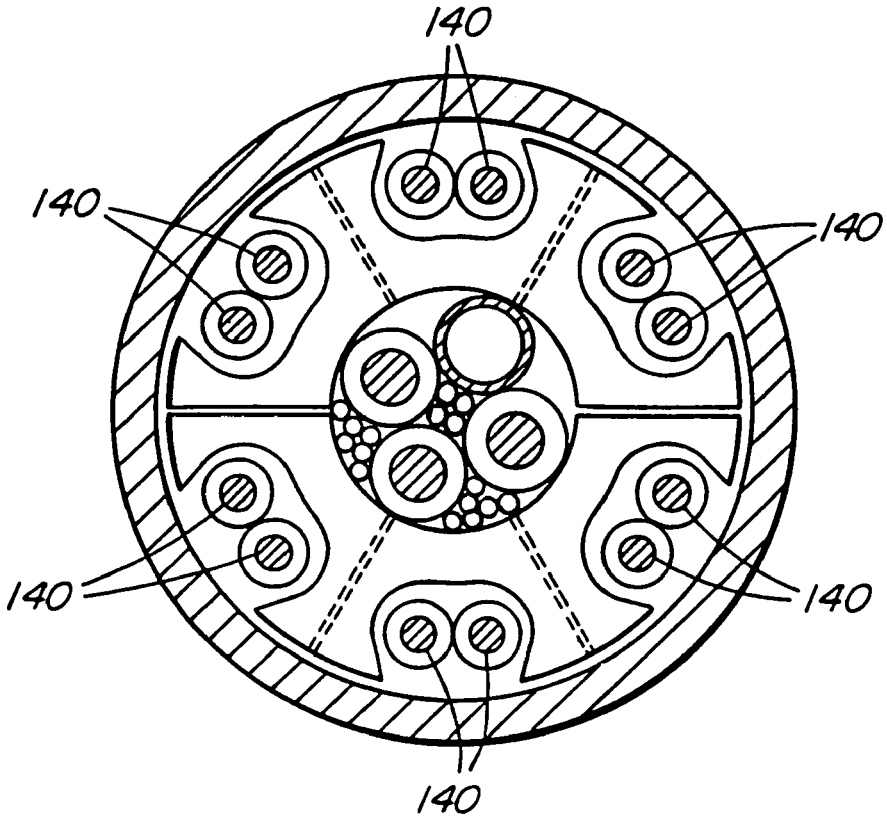
FIG. 18 is an end sectional view of a third alternative internal configuration for the magnetic induction apparatus according to the invention.

FIGS. 16, 17 and 18 illustrate alternative internal configurations for electrical conductors 140 and core 138 but are not intended to limit the various configurations possible. Where close fitting of inductor poles to the casing or liner is practical, additional magnetic poles may be added to the configuration with single or multiple phase wiring through each to suit the requirements. A number of inductors (i.e., core 138 with electrical conductors 140) may be contained in housing 134 with an overall length to suit the requirements and or shipping restraints. A multiplicity of housings 134 may connect several magnetic induction apparatuses 111 together to form a magnetic induction assembly 126. These induction apparatuses 111 may be connected with flanged and bolted joints or with threaded ends similar in configuration and form to those used in the petroleum industry for completion of oil and gas wells. At each connection for magnetic induction apparatus 111, there is positioned a conductive coupling 132. Conductive coupling 132 may consist of various mechanical connectors and flexible lead wires.

Figure 13:
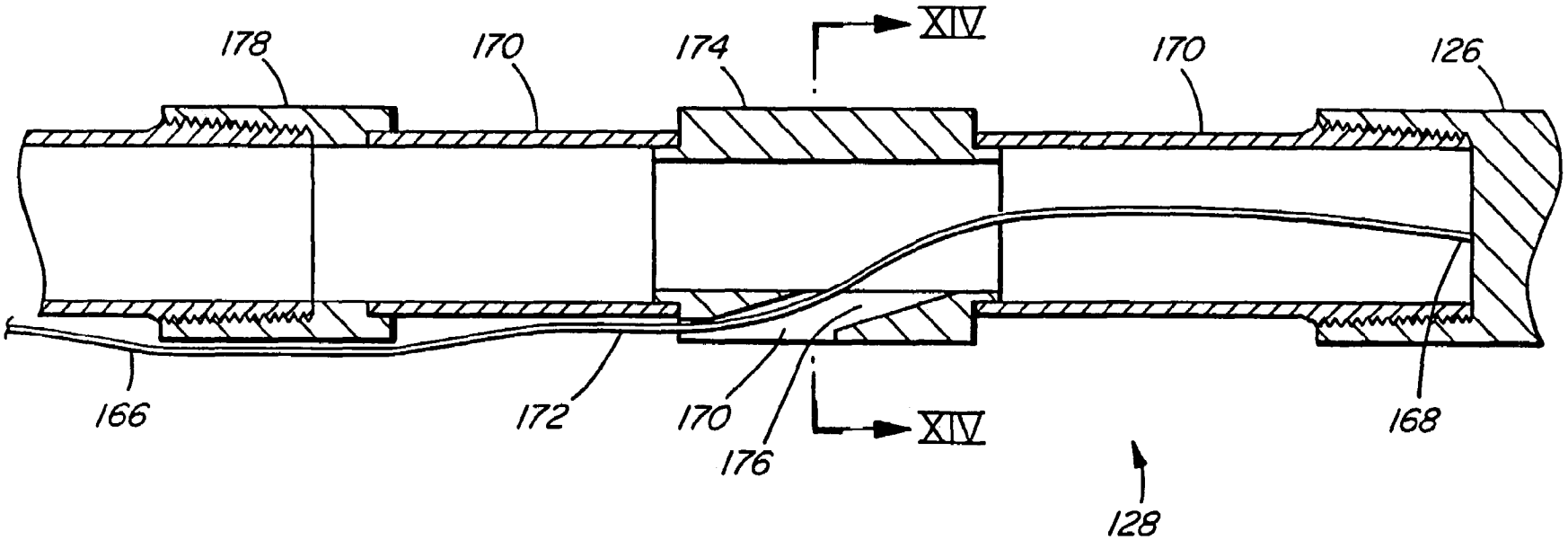
FIG. 13 is a side sectional view of the adapter sub of the magnetic induction assembly illustrated in FIG. 3.
Figure 14:
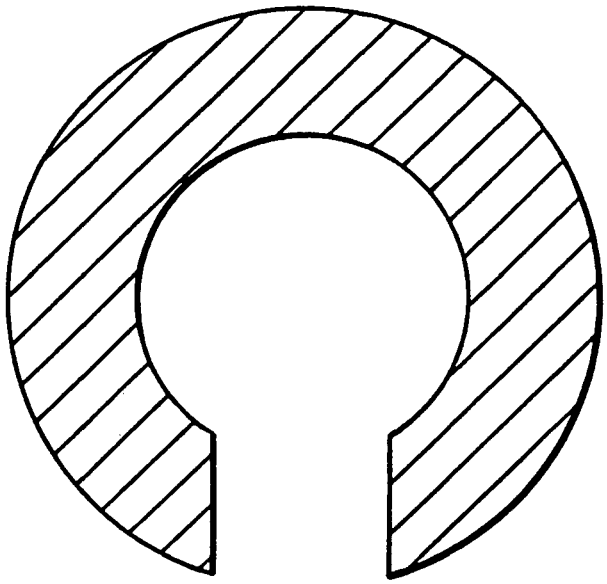
FIG. 14 is an end sectional view taken along lines XIV-XIV of FIG. 13.

The adapter sub 128 (FIG. 13) allows a cable, conveniently electrical submersible pump(ESP) cable 166, to be fed into top 168 of magnetic induction assembly 126 although other types of cables are available. Adapter sub 128 comprises a length of tubing 170 which has an enlarged section 174 near the midpoint such that the ESP cable 166 may pass through tubing 170 and transition to outer face 172 of tubing 70 by passing through a passageway 76 in enlarged section 174. Adapter sub 128 has a threaded coupling 178 to which the wellbore tubulars (not shown) may be attached thereby suspending magnetic induction assembly 126 at the desired location and allowing retrieval of the magnetic induction assembly 126 by withdrawing the wellbore tubulars.

Figure 6:
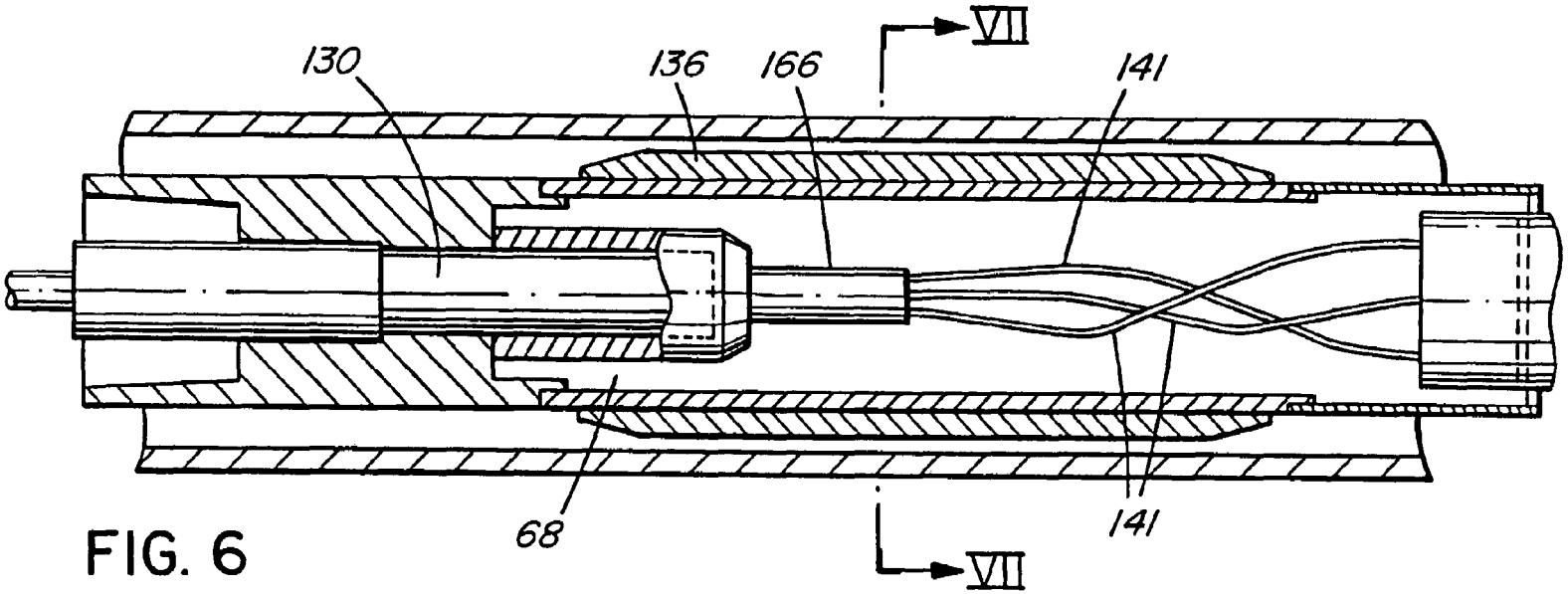
FIG. 6 is a diagrammatic side, cross-sectional view of the primary electrical connection from the magnetic induction assembly illustrated in FIGS. 3 and 4.
Figure 7:
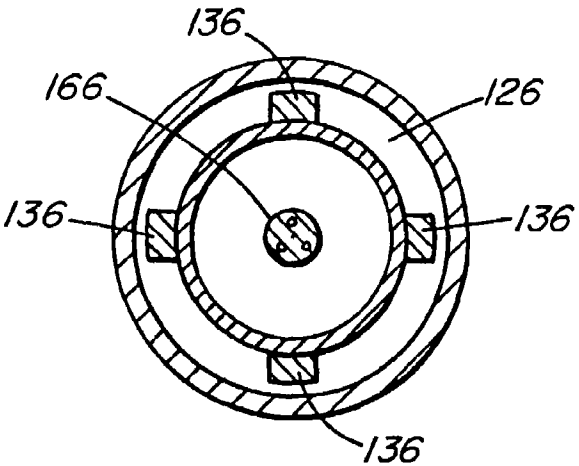
FIG. 7 is a diagrammatic end cross-sectional view, taken along section lines VI-VI of the primary electrical connection illustrated in FIG. 6.
Figure 8:
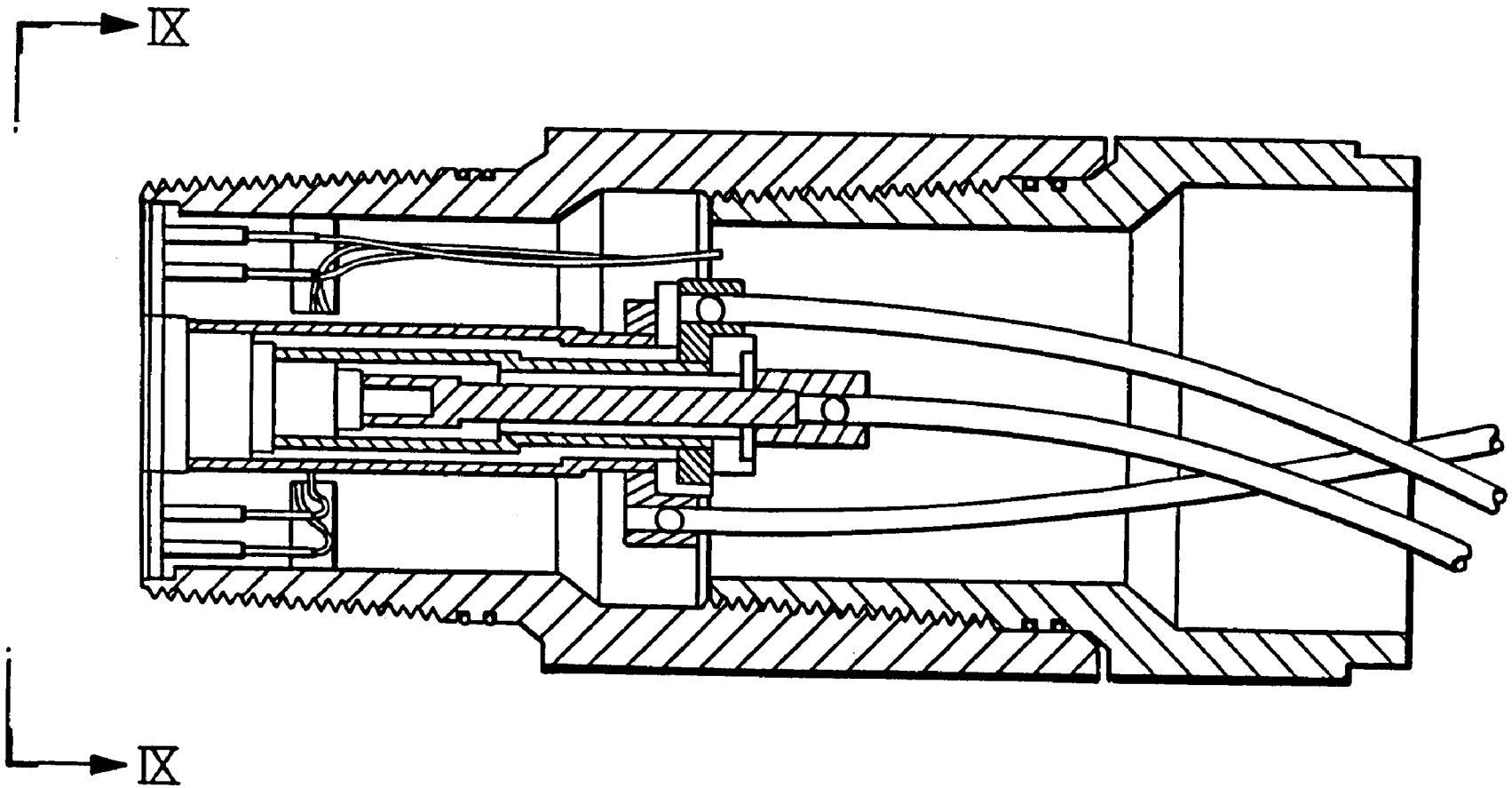
FIG. 8 is a diagrammatic partial side cross-sectional view of the male portion of the conductive coupling from the magnetic induction assembly illustrated in FIG. 3.
Figure 9:
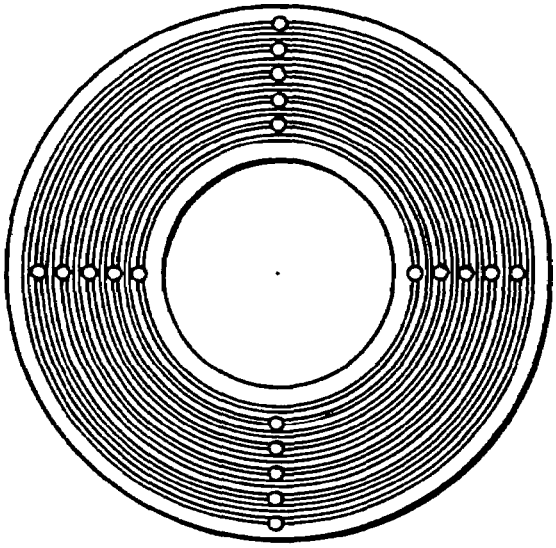
FIG. 9 is an end elevation view of the male portion of the conductive coupling illustrated in FIG. 8 taken along IX-IX of FIG. 8.
Figure 10:
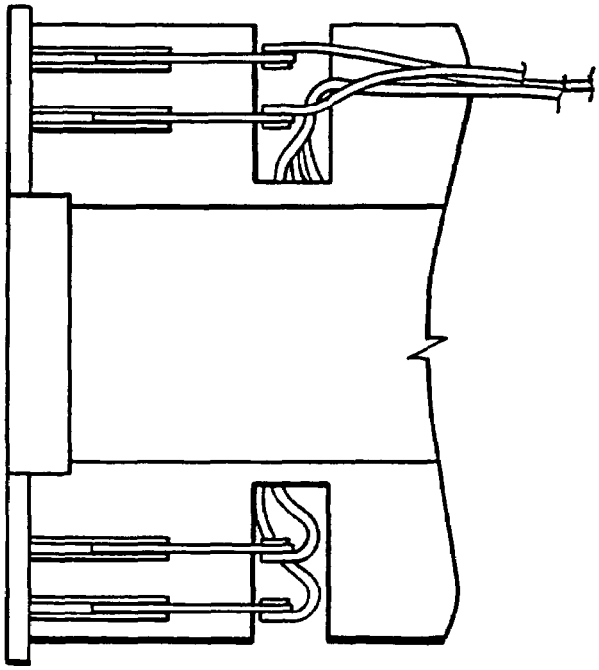
FIG. 10 is a side elevation sectional view of a portion of the male portion of the conductive coupling illustrated in FIG. 8.
Figure 11:
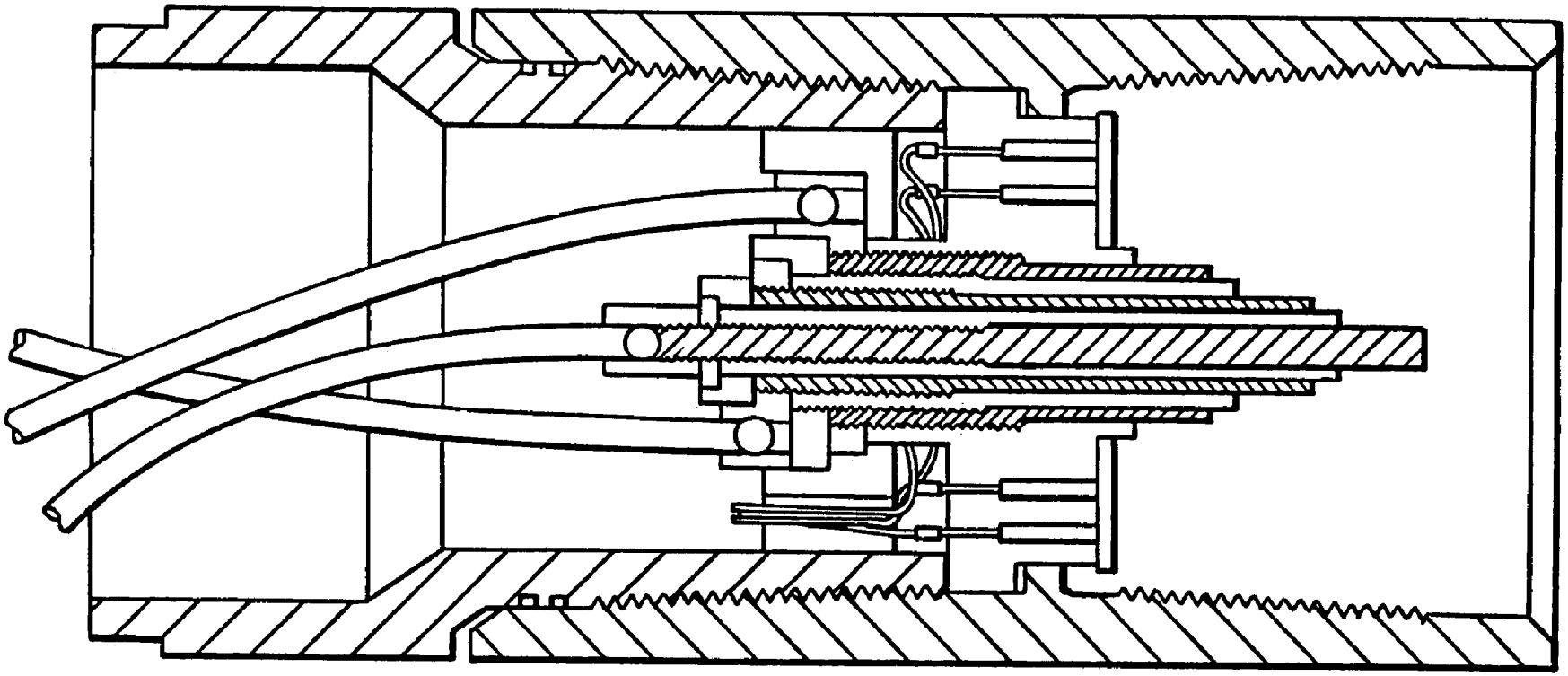
FIG. 11 is a side sectional view of a female portion of the conductive coupling of the magnetic induction assembly illustrated in FIG. 3.
Figure 12:
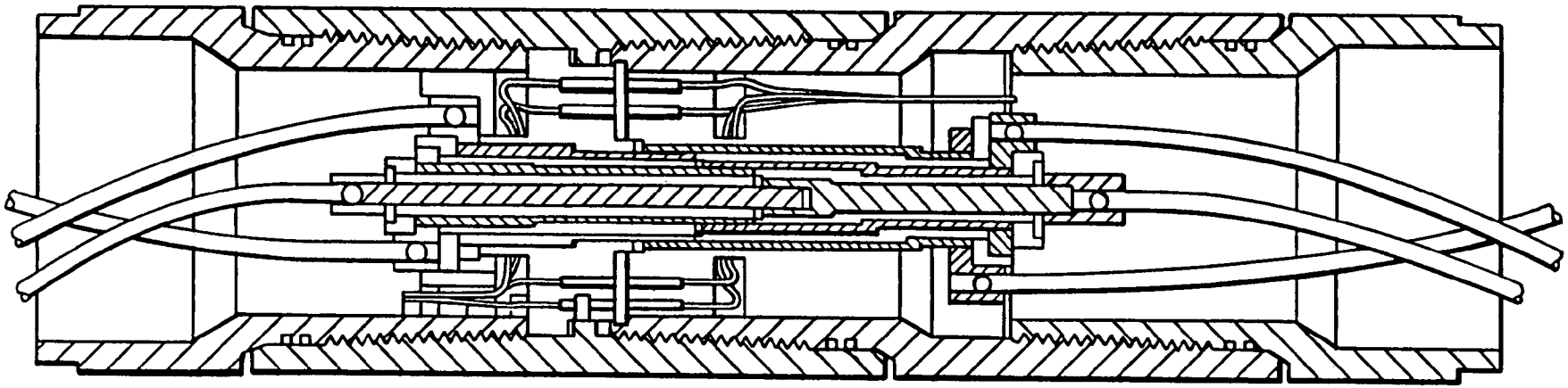
FIG. 12 is a side sectional view of the male portion illustrated in FIG. 8, coupled with the female portion illustrated in FIG. 11.

ESP cable 166 is coupled to an uppermost end 168 of magnetic induction assembly 126 by means of electrical feed through assembly 130 (FIG. 6). These assemblies are specifically designed for connecting cable to cable, cable through a wellhead, and cable to equipment and the like. The connection may also be made through a fabricated pack-off comprised of a multiplicity of insulated conductors with gasket packing compressed in a gland around the conductors so as to seal formation fluids from entering the inductor container. Electrical feed through assembly 130 has the advantage that normal oil field thread make-up procedures may be employed thus facilitating installation and retrieval. Use of a standard power feed allows standard oil field cable splicing practice to be followed when connecting to the ESP cable from magnetic induction assembly 126 to surface.

Figure 15:
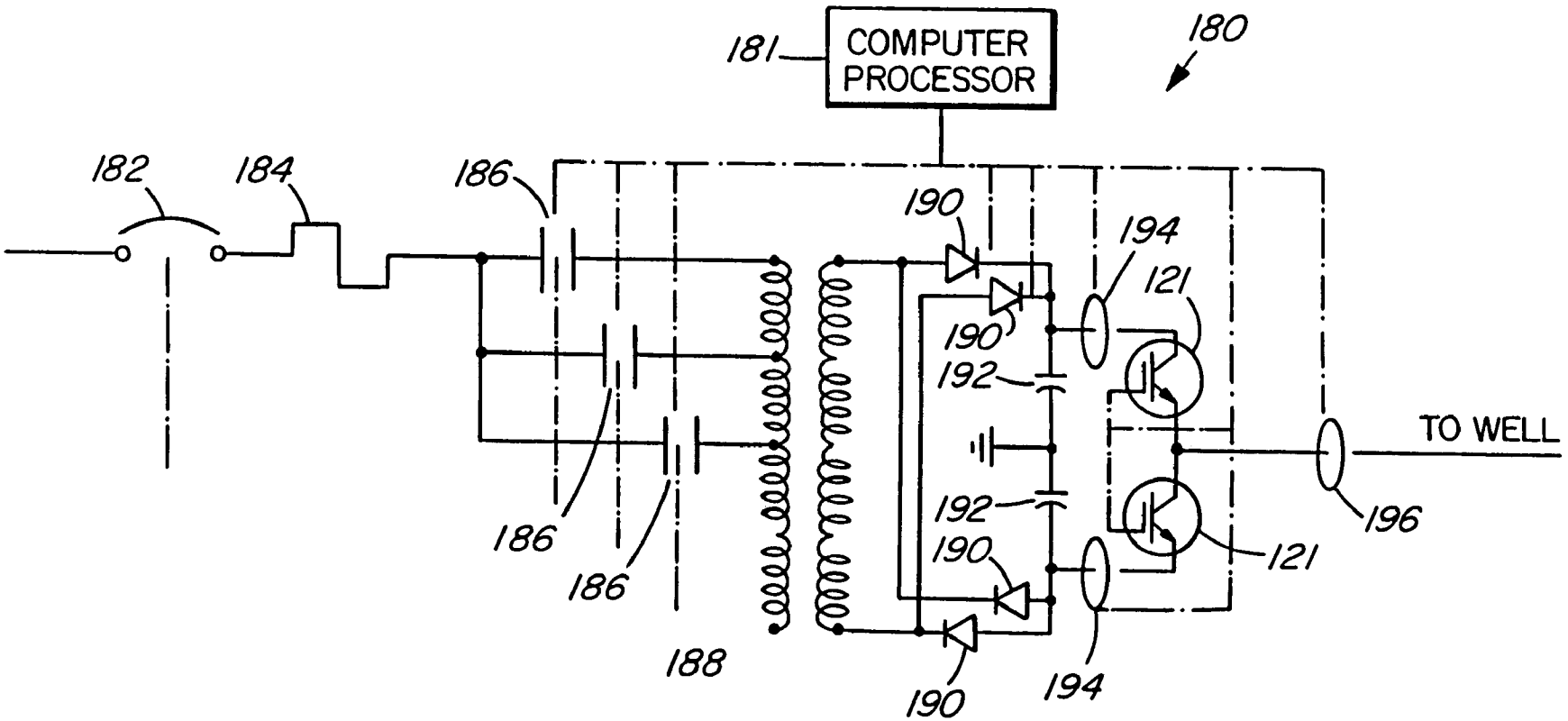
FIG. 15 is a schematic of a power control unit used with the magnetic induction assembly according to the invention.
Figure 19:
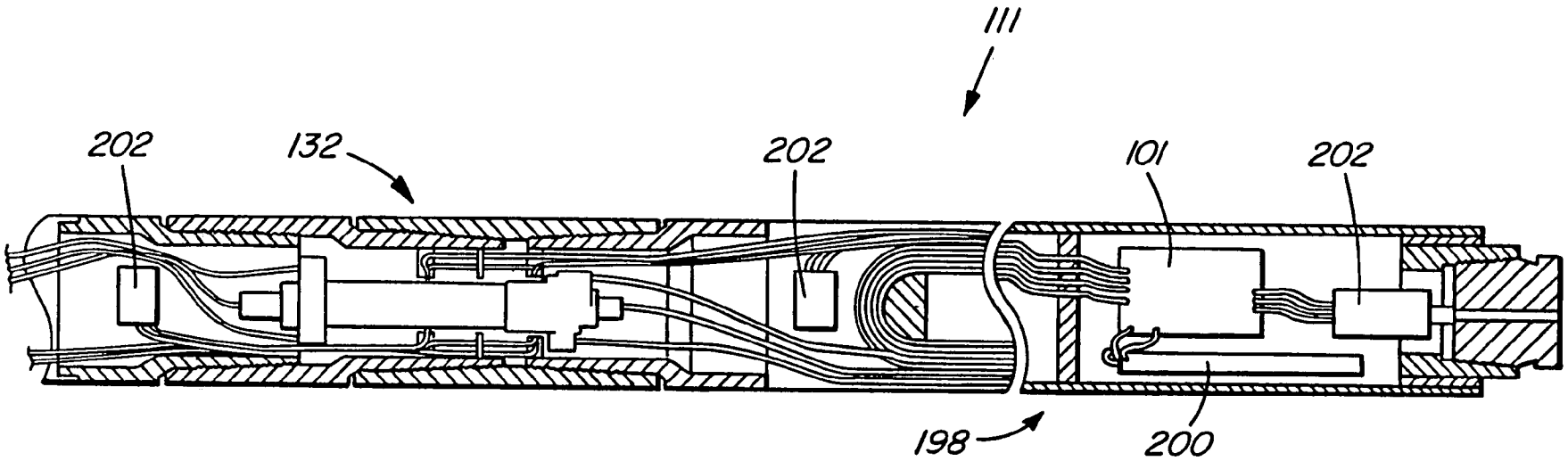
FIG. 19 is a diagrammatic side elevation sectional view of the instrument and sensor components used with the magnetic induction assembly according to the invention.
Figure 20:
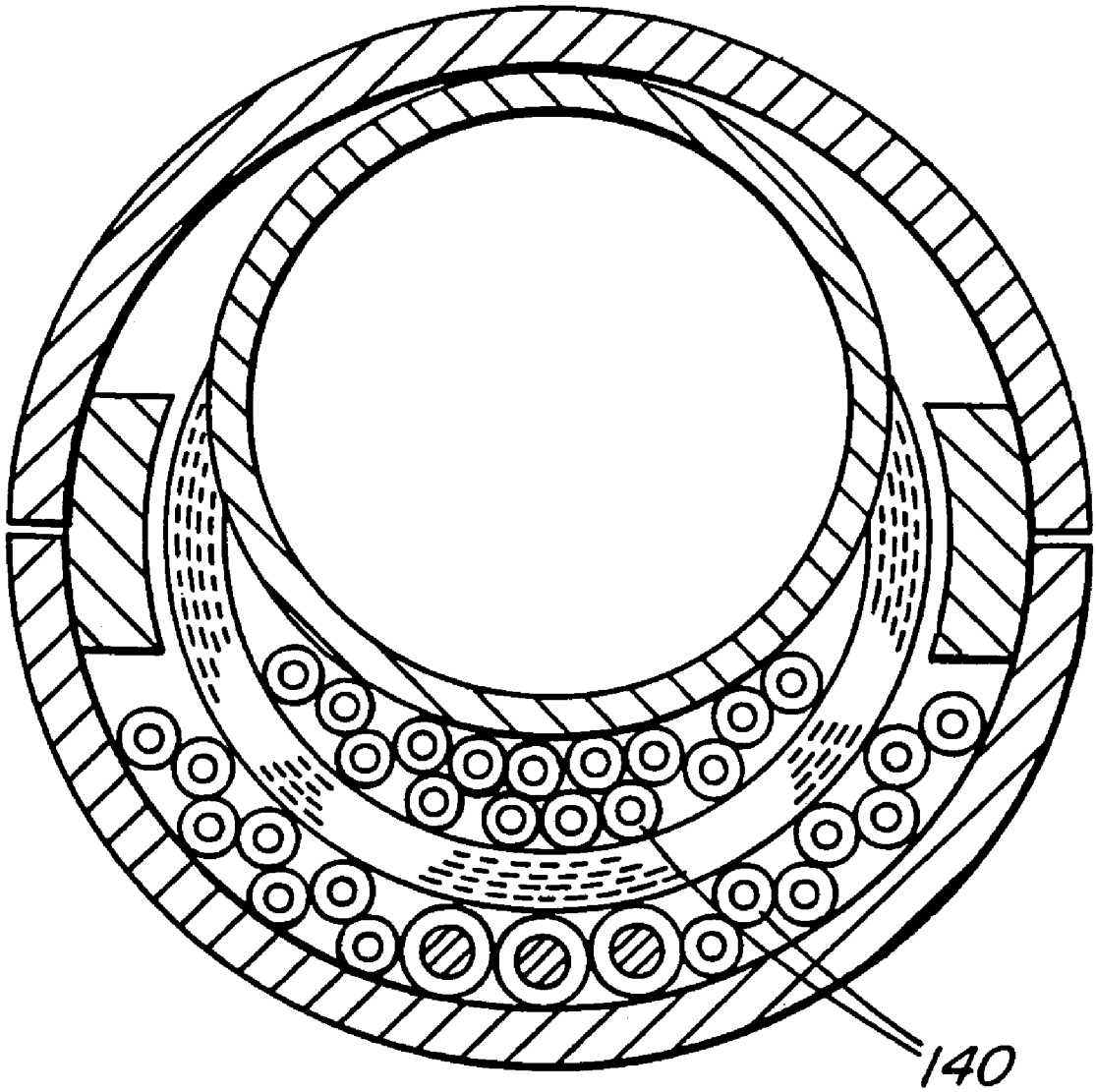
FIG. 20 is an end elevation sectional view of a production tubing heater illustrated in FIG. 3.

Magnetic induction assembly 126 works in conjunction with a power conditioning unit (PCU) 180 located at the surface or other desired location (FIG. 3). PCU 180 utilizes single and multiphase electrical energy either as supplied from electrical systems or portable generators to provide modified output waves for magnetic induction assembly 126. The output wave selected is dependent upon the intended application but square wave forms have been found to be most beneficial in producing heat. Maximum inductive heating is realized from waves having rapid current changes (at a given frequency) such that the generation of square or sharp crested waves are desirable for heating purposes. The PCU 180 has a computer processor 181 (FIG. 15). It is preferred that PCU 180 includes a solid state wave generating device such as silicon controlled rectifier(SCR) or insulated gate bipolar transistor(IGBT) 121 controlled from an interactive computer based control system in order to match system and load requirements. One form of PCU 180 may be configured with a multi tap transformer, SCR or IGBT and current limit sensing on-off controls. The preferred system consists of an incoming breaker, overloads, contactors, followed by a multitap power transformer, an IGBT or SCR bridge network and micro-processor based control system to charge capacitors to a suitable voltage given the variable load demands. The output wave should then be generated by a micro-controller. The micro-controller can be programmed or provided with application specific integrated circuits, in conjunction with interactive control of IG13T and SCR, control the output electrical wave so as to enhance the heating action. Operating controls for each phase include antishoot through controls such that false triggering and over current conditions are avoided and output wave parameters are generated to create the in situ heating as required. Incorporated within the operating and control system is a data storage function to record both operating mode and response so that optimization of the operating mode may be made either under automatic or manual control. PCU 180 includes a supply breaker 182, overloads 184, multiple contactors 186 (or alternatively a multiplicity of thyristors or insulated gate bipolar transistors), a multitap power transformer 188, a three phase IGBT or comparable semiconductor bridge 190, a multiplicity of power capacitors 192, IGST 121 output semiconductor anti shoot through current sensors 194, together with current and voltage sensors 196. PCU 180 delivers single and multiphase variable frequency electrical output waves for the purpose of heating, individual unidirectional output wave, to one or more of magnetic induction apparatuses 111, such that the high current in rush of a DC supply can be avoided. PCU 180 is equipped to receive the downhole instrument signals interpret the signals and control operation in accordance with program arid set points. PCU 180 is connected to the well head with ESP cable 166, which may also carry the information signals (FIG. 3). An instrument device 198 is located within each magnetic induction apparatus 111 (FIG. 19) for the purpose of receiving AC electrical energy from the inductor supply, so as to charge a battery 200, and which, on signal from PCU 180, commences to sense, in a sequential manner, the electrical values of a multiplicity of transducers 202 located at selected positions along magnetic induction apparatus 111 such that temperatures and pressures and such other signals as may be connected at those locations may be sensed and as part of the same sequence. One or more pressure transducers may be sensed to indicate pressure at selected locations and the instrument outputs a sequential series of signals which travel on the power supply wire(s) to the PCU wherein the signal is received and interpreted. Such information may then be used to provide operational control and adjust the output and wave shape to affect the desired output in accordance with control programs contained within the PCU computer and micro controllers.

Operation

Figure 1:
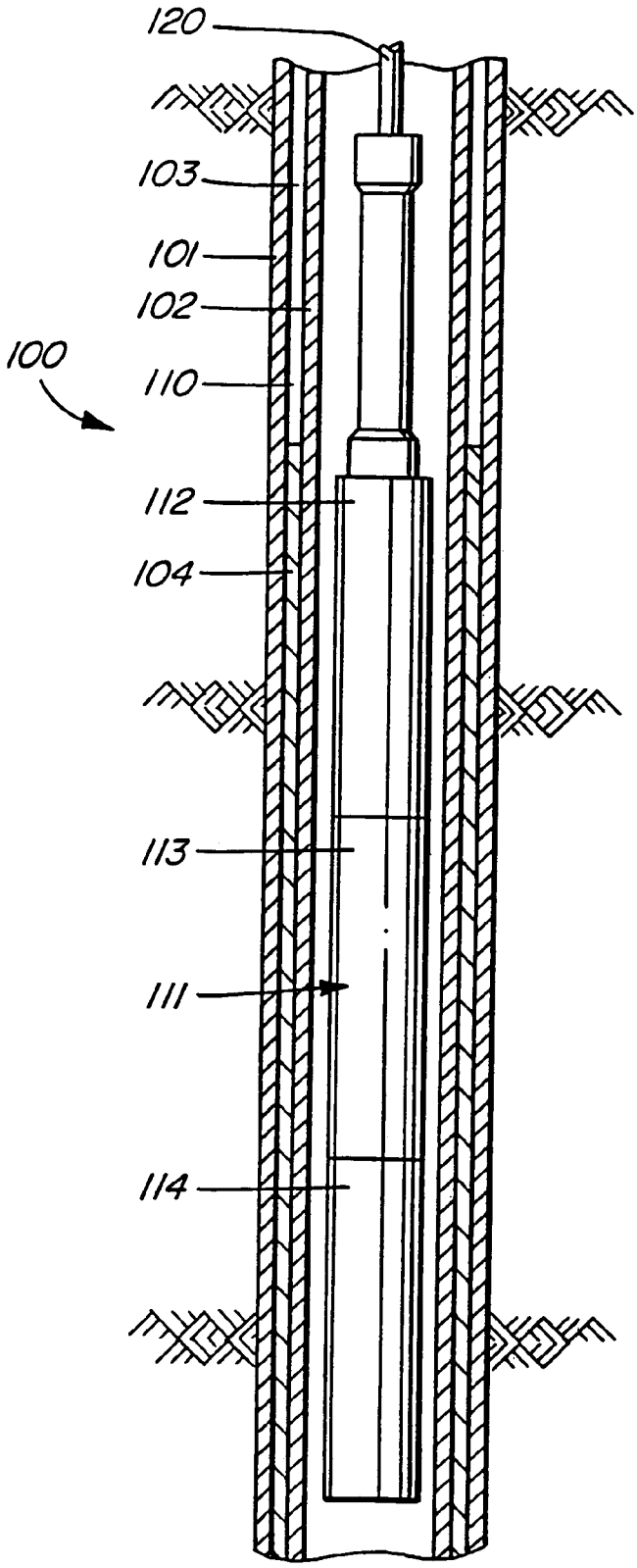
FIG. 1 is diagrammatic cross-sectional view of an oil or gas well particularly illustrating the location of the eutectic metal and the induction apparatus according to one aspect of the invention.

In operation and with initial reference to FIGS. 1 and 2, the eutectic metal, conveniently solder and being in the form of BB's or shot 104, is inserted into the annulus 110 by way of injection port line 103 which has allows installation of the shot 104 to a desired position within the annulus 110. The solder shot 104 is inserted into the annulus 110 to such an extent that the annulus is filled with the shot 104 for a predetermined distance above the well cement 115 as best illustrated in FIG. 2. Radioactive tracer elements can conveniently be added to the shot 104 thereby allowing standard well logging equipment to determine whether the correct location of the shot 104 has been reached and whether it is of consistent thickness or depth around the annulus 110.

Thereafter, the electrical induction heating apparatus 111 is lowered into position within the production casing and its operation is initiated (FIG. 1) as heretofore described. The heat generated by the induction apparatus 111 is transmitted through the production casing 102 to the shot 104 and melts the eutectic metal 104. This timing period can be calculated so that the required melting time period is reached and the temperature of the production casing to obtain such melting can be determined.

Following the melting of the shot 104 and, therefore, the sealing of the annulus 110 above the cement 115 between the surface and production casings 101, 102, the operation of the electrical induction apparatus 111 is terminated and the apparatus 111 is removed from the production casing 102. Any leakage through anomalies 116 in the cement 115 is intended to be terminated by the now solid eutectic metal 104. Of course, additional metal may be added if desired or required. The use of the induction apparatus 111 to generate heat reduces the inherent risk due to the presence of combustible hydrocarbons.

A eutectic metal mixture, such as tin-lead solder 104, is used because the melting and freezing points of the mixture is lower than that of either pure metal in the mixture and, therefore, melting and subsequent solidification of the mixture may be obtained as desired with the operation of the induction apparatus 111 being initiated and terminated appropriately. This mixture also bonds well with the metal of the production and surface casings 102, 101. The addition of bismuth to the mixture can improve the bonding action. Other additions may have the same effect. Other metals or mixtures may well be used for different applications depending upon the specific use desired.

In a further embodiment of the invention, it is contemplated that a material other than a metal and other than a eutectic metal may well be suitable for performing the sealing process.

For example, elemental sulfur and thermosetting plastic resins are contemplated to also be useful in the same process. In the case of both sulfur and resins, pellets could conveniently be injected into the annulus and appropriately positioned at the area of interest as has been described. Thereafter, the solid material is liquified by heating. The heating is then terminated to allow the liquified material to solidify and thereby form the requisite seal in the annulus between the surface and production casing. In the case of sulfur pellets, the melting of the injected pellets would occur at approximately 248 deg. F. Thereafter, the melted sulfur would solidify by terminating the application of heat and allowing the subsequently solidified sulfur to form the seal. Examples of typical thermosetting plastic resins which could conveniently be used would be phenol-formaldehyde, urea-formaldehyde, melamine-formaldehyde resins and the like.

Likewise, while the heating process described in detail is one of electrical induction, it is also contemplated that the heating process could be accomplished with the use of electrical resistance which could assist or replace the electrical induction technique. Indeed, any heating technique could usefully be used that will allow the solid material positioned in the annulus to melt and flow into a tight sealing condition and, when the heating is terminated, allow the material to cool thereby forming the requisite seal. The use of pressure within the annulus might also be used to affect and to initiate the polymerization process when thermosetting resins are being used. For example, high pressure nitrogen or compressed air could be injected into the annulus to increase the pressure in order to enhance the polymerization process.

Figure 21:
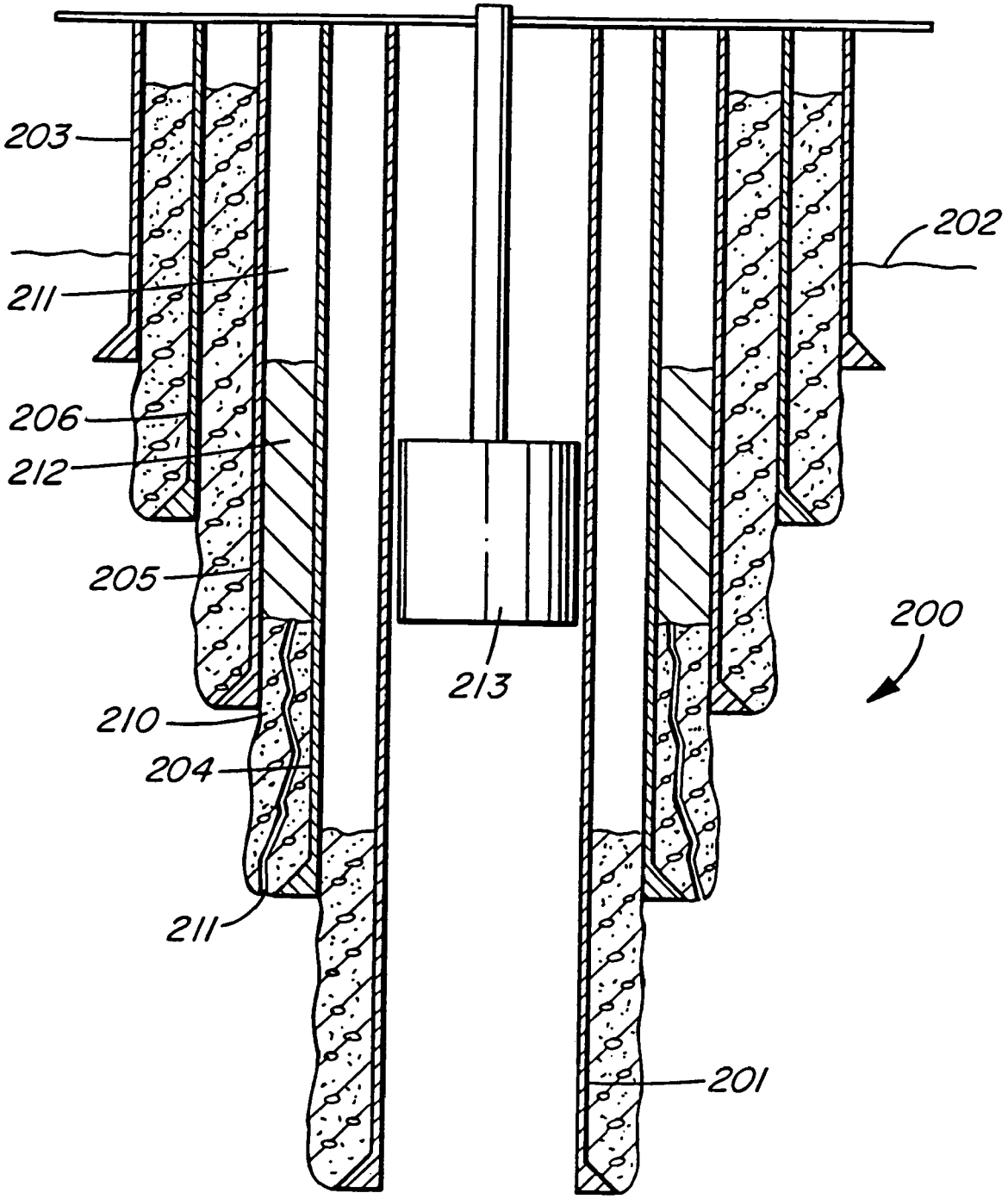
FIG. 21 is a diagrammatic side cross-sectional view similar to FIG. 2 but illustrating a plurality of annuluses within an oil or gas well according to a further aspect of the invention.

Reference is made to FIG. 21 wherein an oil or gas well is generally shown at 200 with the production casing 201 extending the deepest below the mud line 202 and the surface casing 203 being the uppermost casing and having the smallest longitudinal distance. In this instance, there are a plurality of casings between the production and surface casings 201, 203, respectively, namely intermediate casings 204, 205, 206. Such a configuration is particular used in offshore oil and gas wells with each of the intermediate casings 204, 205, 206 having progressively smaller longitudinal distances. Well cement 210 fills the area outside each successive casing and extends upwardly to the next outer casing thereby to form a seal between adjacent casings. For example, cement 210 extends from the bottom of casing 204 and upwardly into the annulus between casings 204, 210 thereby to seal the annulus above the cement 210.

The technique according to the invention is likewise envisioned to be applicable in this event. For example, if there is found to be a fault in the casing cement as at 211 in FIG. 21, the material to be melted, conveniently a eutectic metal such as solder 212 in the correct quantity is placed between the casings 204, 250 in its old and unmelted form. When the correct position for the solder is reached, the application of heat from the heating tool 213 is initiated by the application of power through the switching arrangement as previously described. The heating tool 213 will increase the temperature of the solder to that required to liquify the material thereby forming a pool on the top of the cement 210 and extending about the annulus 211. Upon the liquification process being completed, the application of the excitement or heating from the heating tool 213 will be terminated thereby allowing the liquid solid to again solidify thereby creating an impregnable barrier or seal between the casings 204, 205 and correcting the problems result from the fault 211 in the well cement.

While it is contemplated the induction heating technique will be used with a eutectic metal as previously described, other materials may well likewise be found useful also as previously described. Similarly, other heating techniques might also be useful such as the application of electrical resistance or any excitation of the otherwise solid material which can be used to create the liquid state and, upon excitation termination, will allow the material to solidify thereby forming the seal.

Figure 22:
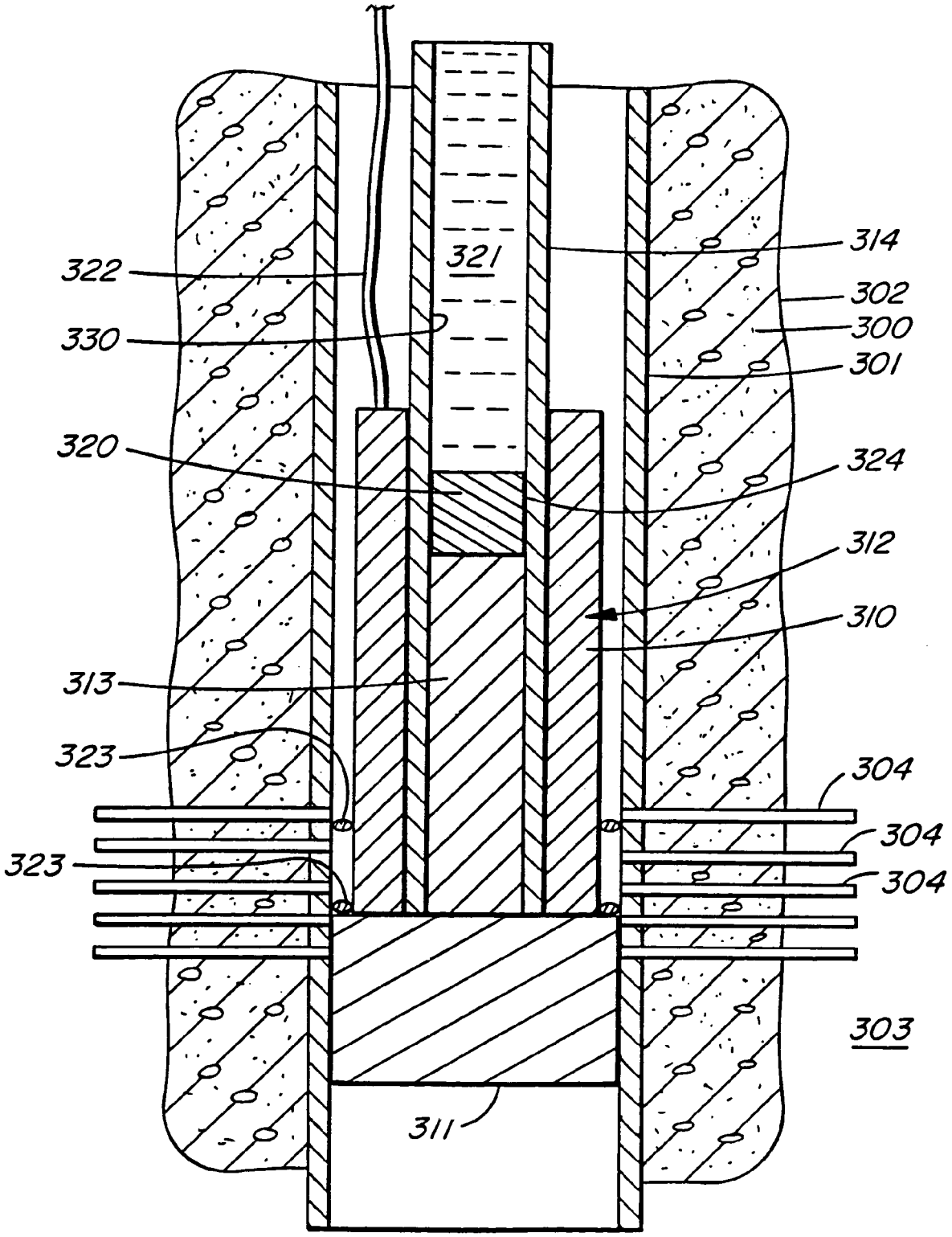
FIG. 22 is a diagrammatic side cross-sectional view of an oil or gas well illustrating the use of a meltable alloy for sealing or repairing a faulty cement sheath between the well casing and the wellbore according to yet a further aspect of the invention.

A further embodiment of the invention is illustrated in FIG. 22. In this embodiment, the use of a metallic material, conveniently a low-melting point bismuth-based alloy material, is used for injection through well perforations and into the cement surrounding the well casing and within the wellbore or into the gas or oil bearing formation itself outside the casing and well cement. Such injections may be used to increase the efficiencies of a producing well or to terminate gas leakage from a well to be abandoned.

Cement generally illustrated at 300 surrounds the well casing 301 in the annular space between the well casing 301 and the wellbore 302. The use of the cement 300 is well known and is used in well sealing operations to prevent the migration of gas originating from the gas bearing formation 303 to the surface through the area between the wellbore 302 and the casing 301.

The casing 301 has perforations 304 extending through the casing 301, the cement 300 and into the gas bearing formation 303. Such perforations are generally formed with the use of bullets fired at depth as is known. The perforations 304 are formed at the depth of the well where the operator has decided that the squeeze of alloy material will have the most beneficial effect in order to seal faults in the cement or well formation which are giving rise to the leaking gas.

In operation, the casing 301 is perforated at the intended depth with the resulting perforations 304 extending through the casing 301 and the cement 300 into the formation 303 as is known. A plug 311 is set within the casing 301 below where the intended squeeze of material into the casing 301 is to occur as is also known. The heater tool generally illustrated at 312 is then lowered into the casing 301 until it reaches the position of plug 311. The heater tool 312 includes the alloy material 313 sought to be squeezed and, to that end and for the pressure application described hereafter, it will conveniently have a hollow central core 330 as is illustrated. Conveniently, the alloy material 313 within the tool 312 is loaded within the tool 312 by way of melting a bar of the appropriate alloy material and allowing the alloy material to solidify within the tool 312 prior to lowering the tool 312 within the well casing 301. Thus, the tool 312 has a barrel 324 which is made from steel or some other material having a high melting point relative to the melting point of the alloy material. If the tool 312 is an inductive type heating tool, the material of the barrel 324 should conveniently be non-ferromagnetic to prevent inefficiencies in the heating process.

While the tool 312 is conveniently contemplated to be an inductive heating type tool such as is described in the present application and in our U.S. Pat. No. 6,384,389, other heating tools are also contemplated including resistance type heating tools which do not use the inductive heating technique.

The heating tool 312 is lowered into the well casing 301, conveniently by way of well tubing 314, until the plug 311 is reached. A piston 320 is positioned on top of the alloy material 313 and is appropriately sealed to make it fluid tight within the tool 312. Hydraulic fluid 321 is provided above the piston 320 within the tubing 314 so that hydraulic pressure may be exerted on the piston 320 by the fluid 321.

The heating tool 312 is then powered up by way of power provided through the attached power cable 322. Regardless of whether the tool is an inductive type heating tool or a resistive type heating tool, or a combination of both, the alloy material 312 is heated until it melts and is then continuously heated thereafter until it reaches a temperature well above its melting point.

Pressure is then applied to piston 320 by way of the hydraulic fluid 321 which expels the liquid alloy material and squeezes the liquid material through the perforations 304 and into the adjacent well cement 300 and formation 303. The seals 323 positioned between the annulus of the tool 312 and the well casing 301 prevent the liquid material form rising within the annulus between the tool 312 and the casing 301.

As the liquid material is expelled from the tool 312 and into the perforations 304, the tool 312 is raised off the plug 311 until the liquified material is fully expelled from the tool 312. Power to the tool 312 is then terminated and the tool 312 is removed from the well casing 301. Following solidification of the alloy material within the well casing 301, the material together with the plug 311 may be drilled out as is known if the well is intended to continue in production or it can be left undrilled in place if the well is to be abandoned. The cooled liquified alloy material within the faults in the cement and/or formation expands slightly because of its bismuth content and fills and seals the faults which have been filled during the squeezing operation.

It is contemplated that the pressure on the piston 320 may conveniently be applied mechanically as well as with the use of hydraulic pressure. Such mechanically applied pressure may be accomplished by the use of connecting rods similar to pump sucker rods which are connected to the piston in a manner similar to that used for downhole sucker rod pumps.

Many materials, including and in addition to eutectic materials, are contemplated to be useful for melting by the tool 312 and being subsequently squeezed into the perforations 304, besides the conveniently available bismuth alloy which, in a molten state, has a low viscosity of approximately 50 centipoises(cp).

Figure 23:
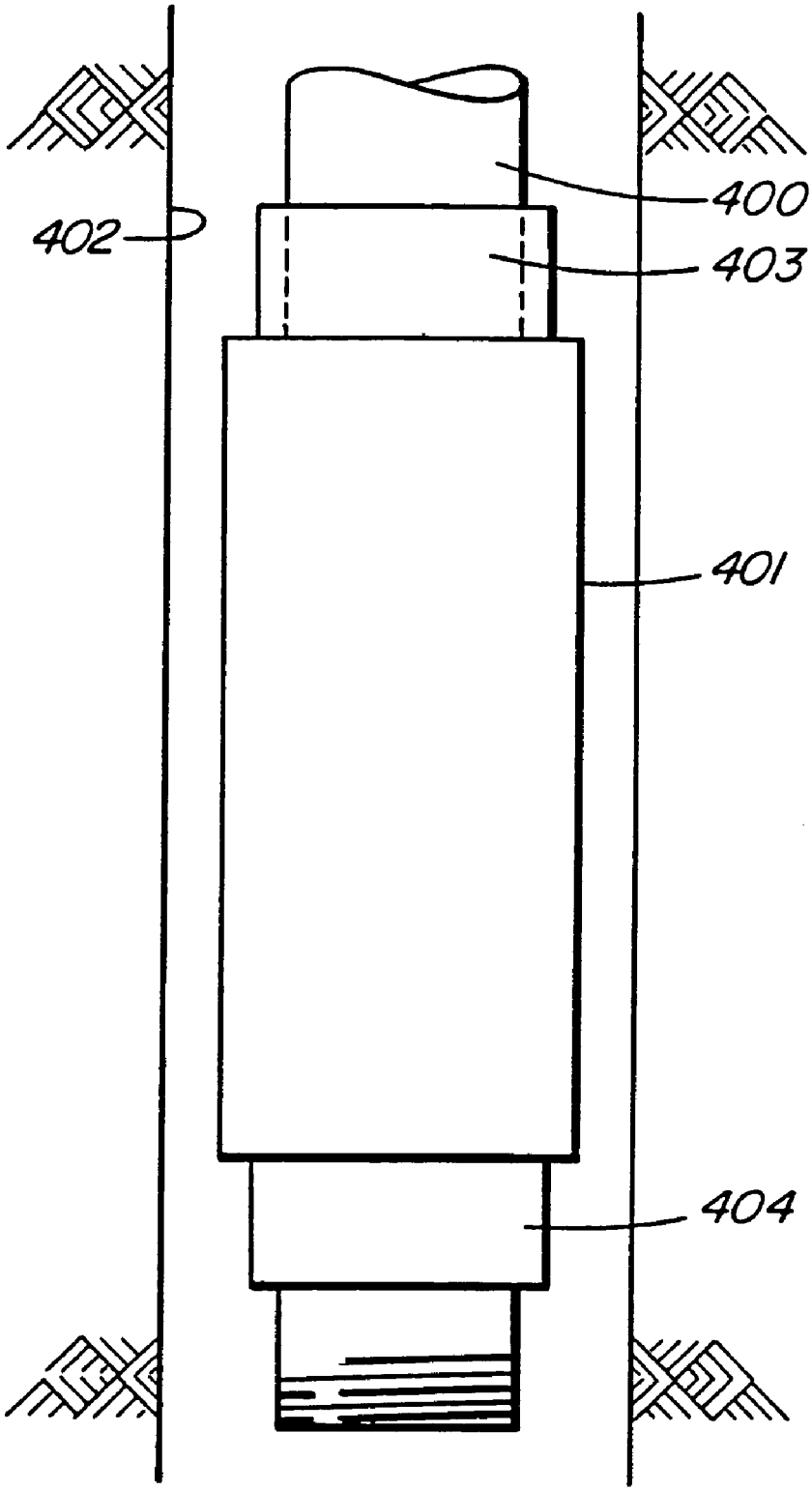
FIG. 23 is a side diagrammatic cross-sectional view of the casing of an oil or gas well with a material surrounding the casing which material may be melted to form a seal outside the casing according to yet a further aspect of the invention.

A further aspect of the invention is illustrated in FIG. 23 in which well casing 400 has a sheath or collar 401 formed around the circumference of the casing 400. The collar 401 is made of an appropriate material which has a relatively low temperature melting point and which is intended to be melted following the lowering of the casing 400 within the wellbore 402, the melting taking place by means of a heating tool, conveniently of the inductive type as described herein (not illustrated in FIG. 23) which is lowered within the casing 400 and which raises the temperature of the collar 401 to a value such that the metal melts and forms the seal in the annulus between the wellbore 402 and the outside of the casing 400. The material may be an eutectic material or another appropriate material as has been described herein. The melted material, when solidified, forms a backup seal for the usual cement pumped into the annulus from the casing.

The sheath or collar 401 may be molded around the casing 400 with removable molds prior to the casing 400 being lowered in the wellbore 402. Alternatively, the collar 401 could be made from a wire material wound about the casing 400 with the wire material being made from an alloy material with the appropriate melting and solidification temperatures to as to be satisfactorily used.

In operation, the well casing 401 with the attached collar 401 mounted between couplings 403, 404 will be lowered to the area of interest as obtained with well logging instruments and the like as is known. Cement will be pumped downwards through the casing 400 and upwardly within the annulus between the casing 400 and the wellbore 402 in a conventional manner as illustrated by the arrows in FIG. 23. The cement should have a setting time long enough to allow a heating tool to be lowered into the well casing 400 until it reaches the depth adjacent the collar 401 wherein power is applied to the heating tool which raises the temperature of the collar 401 until it melts and flows from the casing 400 into the annulus.

The melted material of the collar 401 will displace the non-solid cement in the annulus since the density of the melted alloy material is greater than that of the cement. The melted alloy material will likewise not flow downwardly in the annulus because it solidifies when it leaves the immediate area of the collar 401 with the attendant heating tool adjacent therein within casing 400. The alloy material cools and solidifies in the annulus thereby forming an impermeable plug in the annulus which acts as a backup for the cement seal and seals the annulus from gas and/or fluid migration upwardly through the annulus.

While the heating tool used for heating the collar material is conveniently one of the inductive type as described herein, it may also be a resistance type heater.

Many additional modifications will readily occur to those skilled in the art to which the invention relates and the specific embodiments described should be taken as illustrative of the invention only and not as limiting its scope as defined in accordance with the accompanying claims.

I claim:

1. Apparatus for heating a material used for sealing faults within the cement used for sealing an oil or gas well, said apparatus comprising a heating tool having a generally cylindrical configuration, a power cable to provide power to said heating tool, a wire line mounting means to mount said heating tool to a wire line for raising and lowering said heating tool within said oil or gas well, a hollow core within said heating tool for carrying meltable material in a solid state and for allowing said meltable material to transition from said solid state within said hollow core to a liquefied state within said hollow core upon heating of said meltable material in said solid state within said hollow core of said heating tool, pressure applying means within said heating tool for applying pressure to said meltable material following said liquefying of said meltable material within said hollow core of said heating tool and for forcing said liquefied material from said tool.

2. Apparatus as in claim 1 wherein said heating tool is an induction type heating tool and said power cable provides power to said induction time heating tool.

3. Apparatus as in claim 2 wherein said heating tool is a resistive type heating tool and said power cable provides power to said resistive type heating tool.

4. Apparatus as in claim 2 wherein said heating tool has a barrel surrounding said meltable material, said barrel being made of a material having a high melting point relative to said meltable material.

5. Apparatus as in claim 4 wherein said barrel is made from a ferromagnetic material.

* * * * *